US007068233B2

(12) United States Patent
Thornberg et al.

(10) Patent No.: US 7,068,233 B2
(45) Date of Patent: Jun. 27, 2006

(54) INTEGRATED MULTIPATH LIMITING GROUND BASED ANTENNA

(75) Inventors: D. Bryce Thornberg, Hurricane, UT (US); Dean S. Thornberg, Salt Lake City, UT (US)

(73) Assignee: db Systems, Inc., Hurricane, UT (US)

( * ) Notice: Subject to any disclaimer, the term of this patent is extended or adjusted under 35 U.S.C. 154(b) by 254 days.

(21) Appl. No.: 10/430,959

(22) Filed: May 5, 2003

(65) Prior Publication Data

US 2003/0206140 A1 Nov. 6, 2003

Related U.S. Application Data

(60) Provisional application No. 60/378,700, filed on May 6, 2002.

(51) Int. Cl.
*H01Q 21/28* (2006.01)

(52) U.S. Cl. ..... 343/727; 343/792; 343/853

(58) Field of Classification Search ..... 343/807–809, 343/725, 853, 792, 797, 727
See application file for complete search history.

(56) References Cited

U.S. PATENT DOCUMENTS

| | | | | |
|---|---|---|---|---|
| 2,767,397 A | | 10/1956 | Byrne | |
| 3,579,244 A | * | 5/1971 | Dempsey et al. | 343/797 |
| 3,691,562 A | | 9/1972 | Parker et al. | |
| 3,747,111 A | | 7/1973 | Fletcher et al. | |
| 4,030,100 A | | 6/1977 | Perrotti | |
| 4,297,707 A | | 10/1981 | Brunner et al. | |
| 4,329,690 A | | 5/1982 | Parker | |
| 4,730,195 A | | 3/1988 | Phillips et al. | |
| 4,963,879 A | * | 10/1990 | Lin | 343/792 |
| 5,317,327 A | | 5/1994 | Piole | |
| 5,434,580 A | | 7/1995 | Raguenet et al. | |
| 5,557,656 A | * | 9/1996 | Ray et al. | 455/431 |
| 5,654,717 A | | 8/1997 | Nichols et al. | |
| 5,831,577 A | | 11/1998 | Nichols et al. | |
| 5,838,282 A | | 11/1998 | Lalezari et al. | |
| 5,859,618 A | | 1/1999 | Miller, II et al. | |
| 6,023,245 A | | 2/2000 | Gomez et al. | |
| 6,049,305 A | | 4/2000 | Tassoudji et al. | |
| 6,160,512 A | | 12/2000 | Desclos et al. | |
| 6,181,286 B1 | | 1/2001 | Roscoe et al. | |
| 6,329,954 B1 | | 12/2001 | Fuchs et al. | |

* cited by examiner

*Primary Examiner*—Michael C. Wimer
(74) *Attorney, Agent, or Firm*—K. S. Cornaby

(57) ABSTRACT

An integrated dual antenna system for Global Positioning System (GPS), Local Area Augmentation System (LAAS), ground based subsystem surface mounted (pole/tower/platform/other) and coaxially stacked (over and under). The dual antenna and receiver system is specifically designed and tuned to receive only the direct GPS satellite ranging signals while highly rejecting the ground multipath (indirect) signals. The upper antenna is a Right Hand Circularly Polarized (RHCP) omni-directional High Zenith Antenna (HZA) with dual obstruction lights and dual air terminals. The lower antenna is an electrically long vertically polarized omni-directional linear phased array having a very sharp horizon cut off and is a Multipath Limiting Antenna (MLA). When the two antennas (MLA and HZA) are mounted together they become the Integrated Multipath Limiting Antenna (IMLA). Interoperability is assured by high RF isolation between antennas. Both antennas are broad-band and have precisely controlled vertical and horizontal radiation patterns. Together the radiation patterns cover the complete upper hemisphere where satellites are visible.

6 Claims, 14 Drawing Sheets

Multipath Limiting Antenna Radiation Patterns
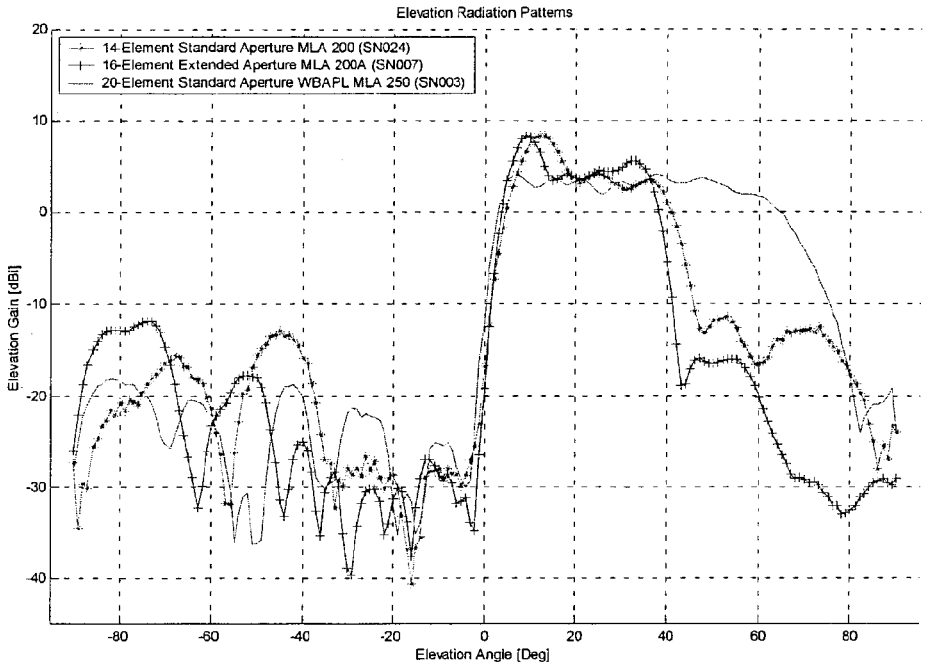
Figure 7: MLA Elevation Gain Pattern Comparison
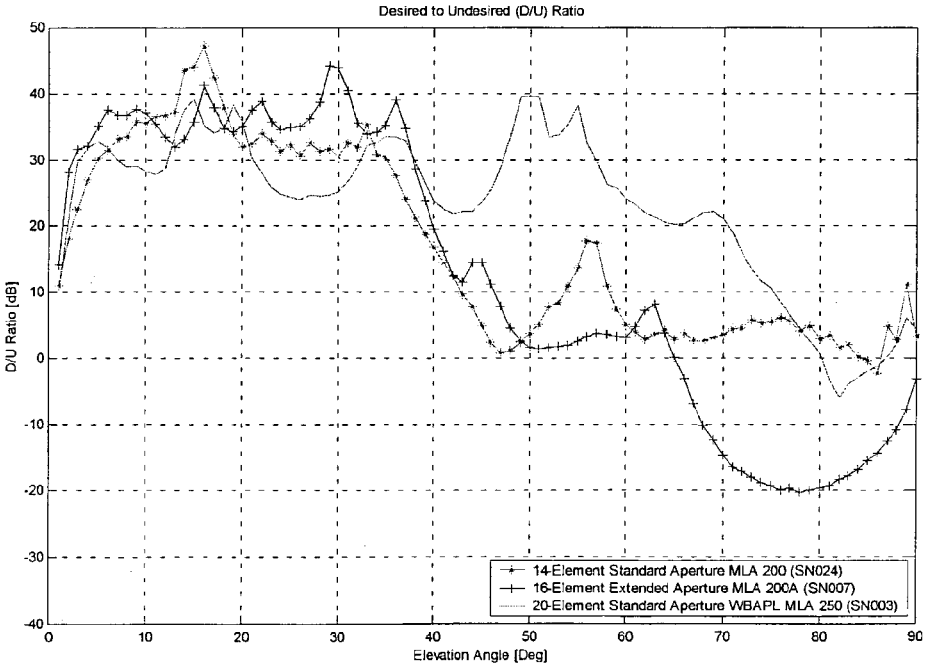
Figure 8: MLA Desired to Undesired Ratio

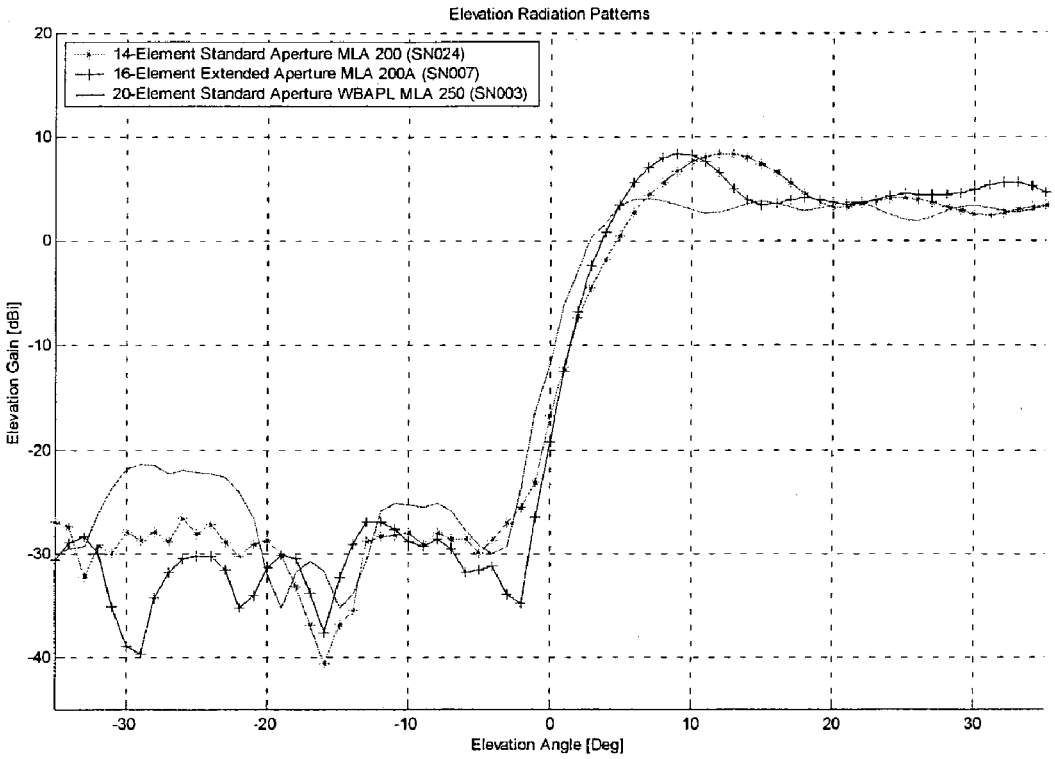
Figure 9: MLA Elevation Gain Pattern Comparison Zoomed to 35 Degrees

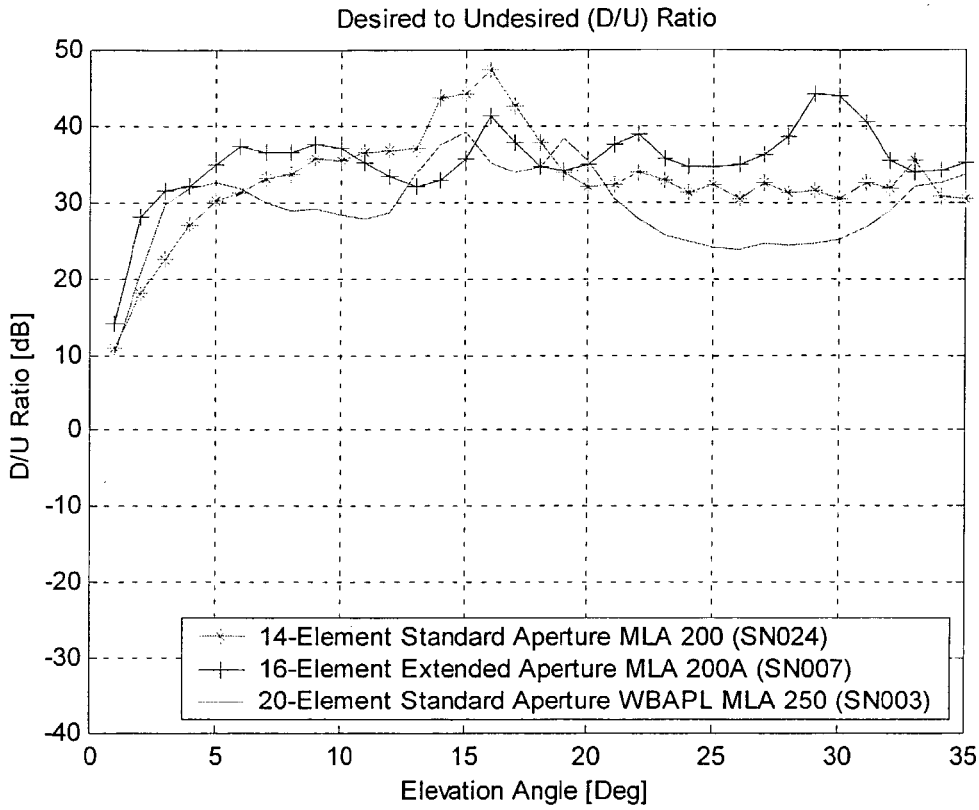
Figure 10: MLA Desired to Undesired Ratio Zoomed to 35 Degrees
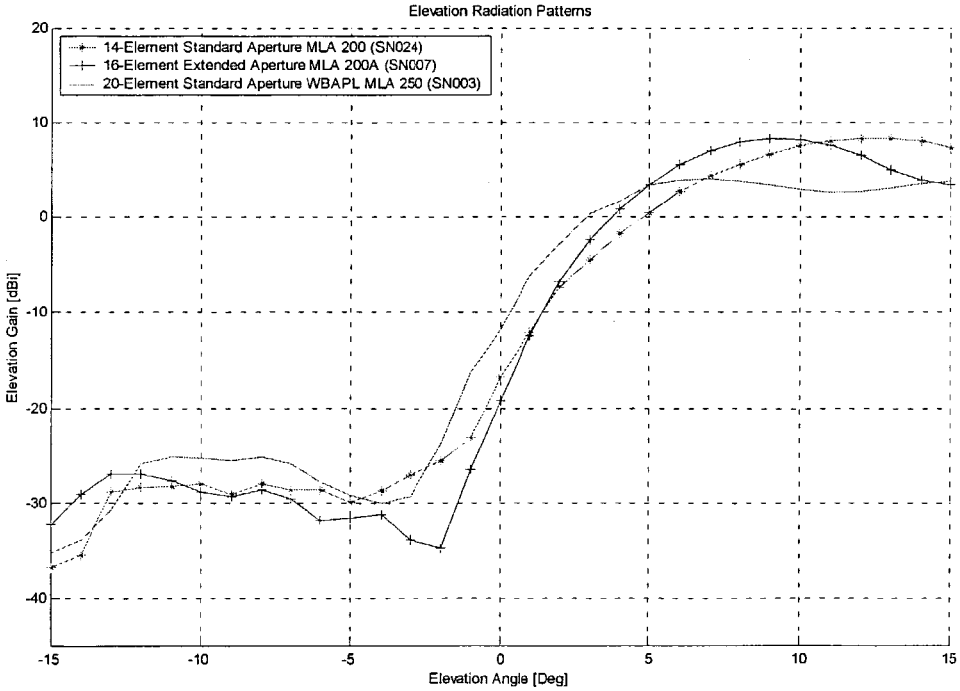
Figure 11: MLA Elevation Gain Pattern Comparison Zoomed to 15 degrees

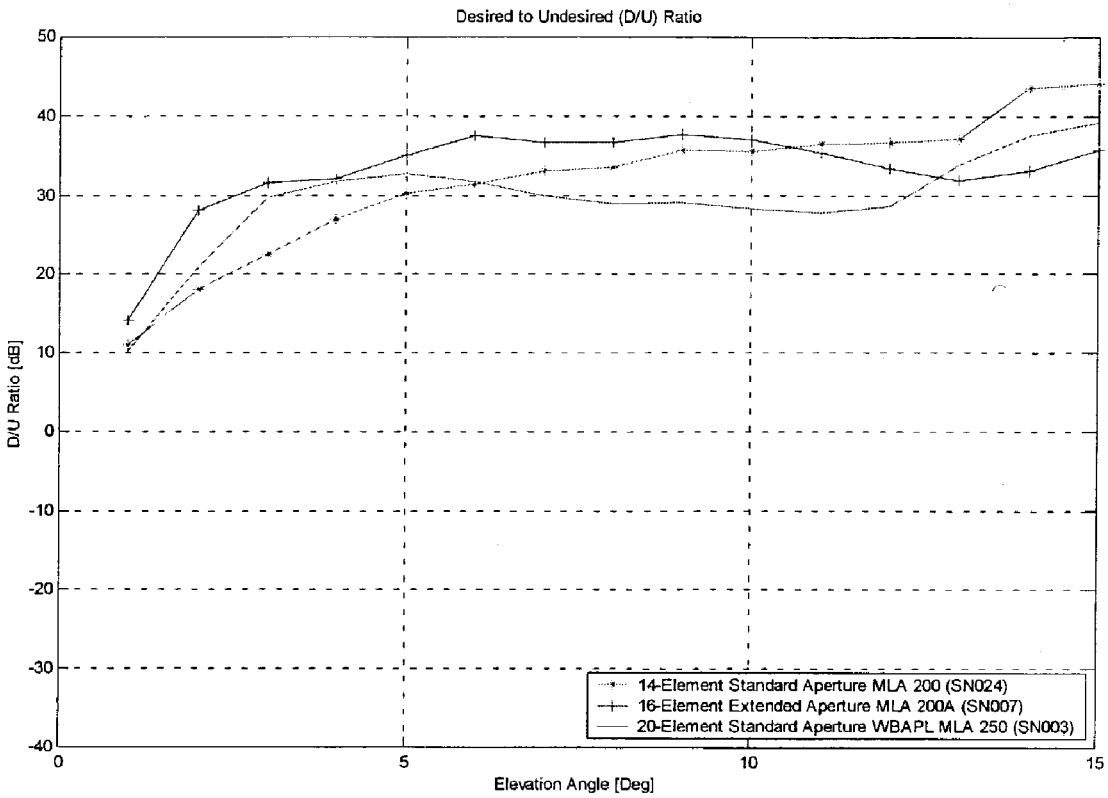
Figure 12: MLA Desired to Undesired Ratio Zoomed to 15 degrees

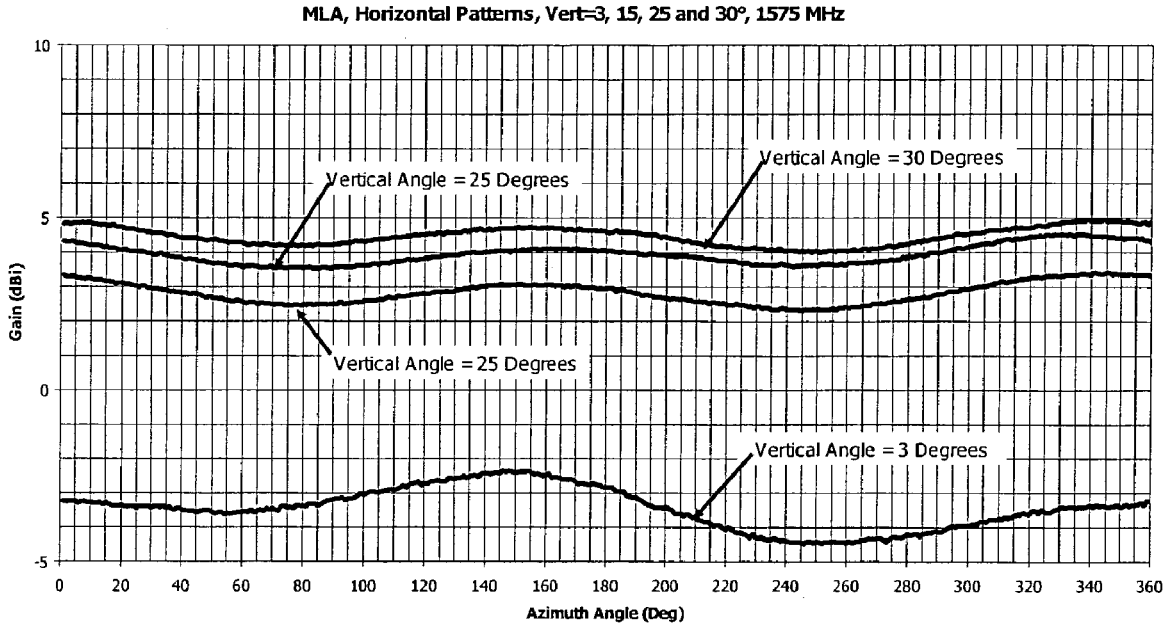
Figure 13: MLA Azimuth Pattern

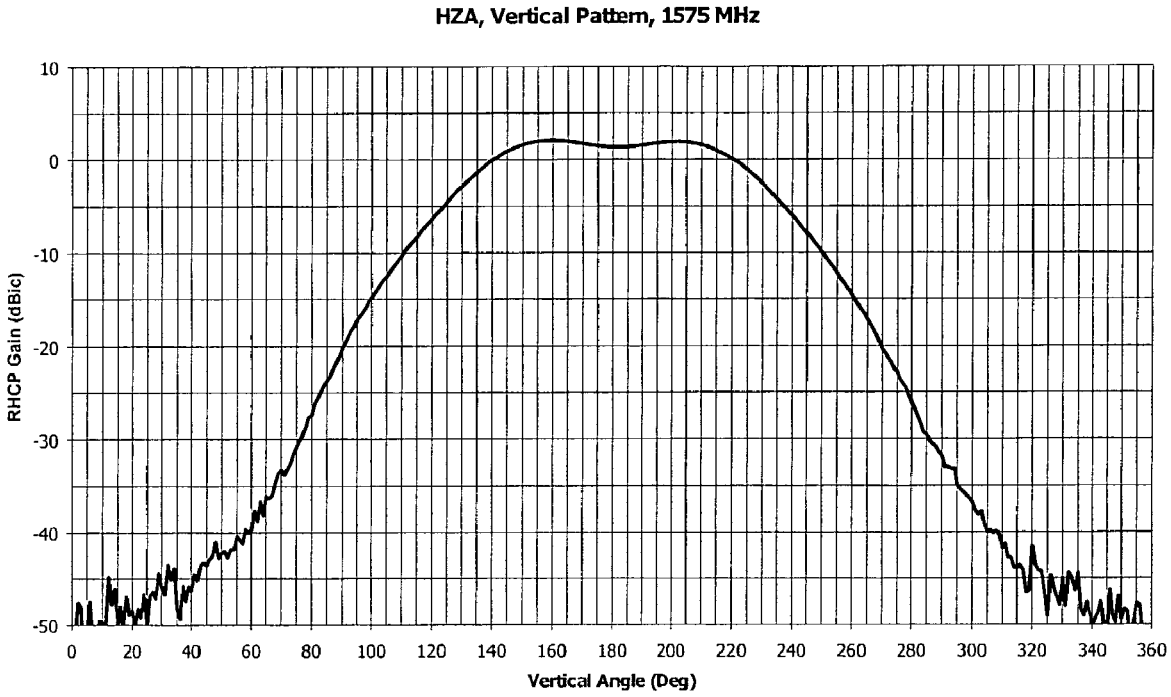
Figure 14: HZA Vertical Pattern

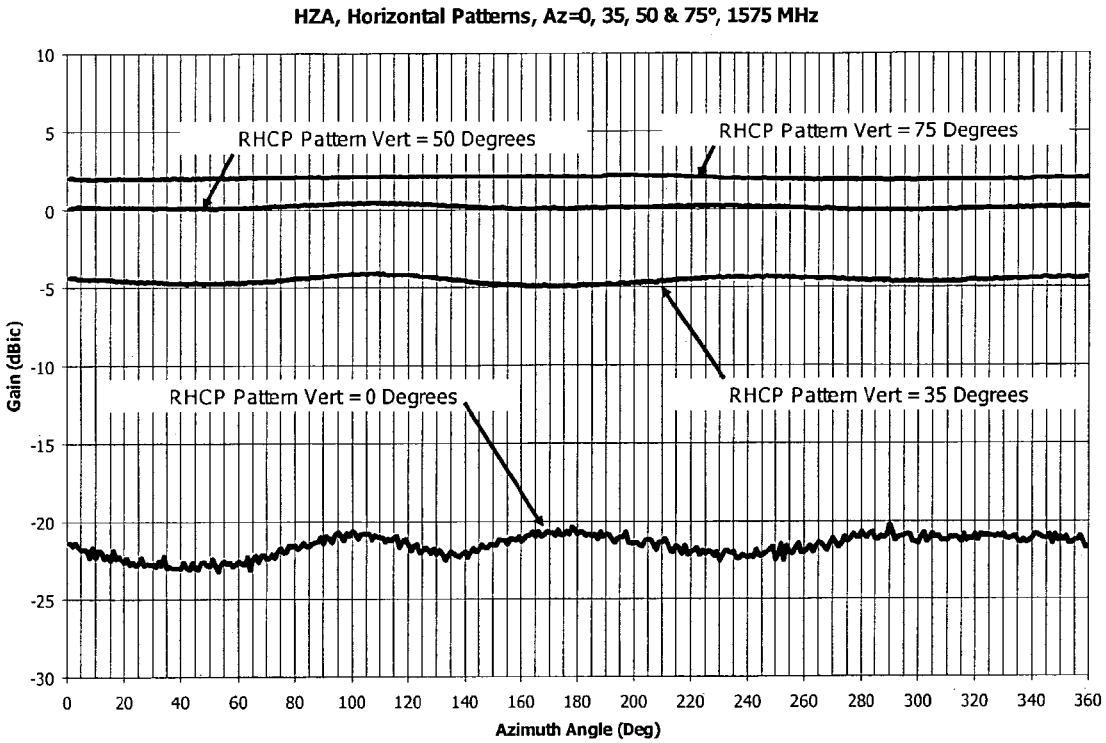
Figure 15: HZA Azimuth Patterns
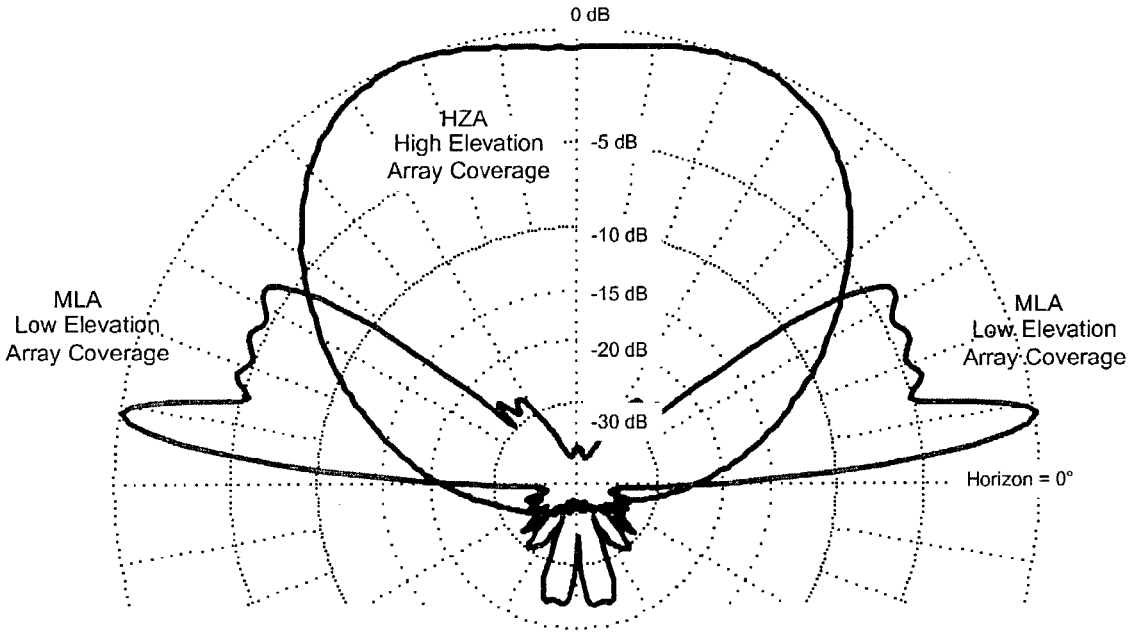
Figure 16: IMLA Pattern Combination Radiation

INTEGRATED MULTIPATH LIMITING GROUND BASED ANTENNA

This application claims the benefit of U.S. Provisional Application No. 60/378,700 filed May 6, 2002.

BACKGROUND OF THE INVENTION

The Local Area Augmentation System (LAAS) is in the late stages of being developed to support the differential Global Navigational Satellite System (GNSS) based aircraft precision approaches and landings. Applications other than precision approach and landing may also be supported. The LAAS, when implemented using the Global Positioning System (GPS) as the source of satellite navigation signals, is known as the GPS/LAAS and is shown in FIG. 17. It consists of three primary subsystems:

A) The satellite subsystem, which produces ranging signals. This standard explicitly addresses the use of GPS and SBAS (satellite based augmentation system). Provision has been made for the use of other satellite systems such as the Russian GLONASS.

B) The ground subsystem, which provides a VHF data broadcast (VDB) containing differential corrections and other pertinent information. Ground-based ranging signals may also be provided by airport pseudolites (APL's) to enhance system availability.

C) The airborne subsystem, which encompasses the use of aircraft equipment, receives and processes the LAAS/GPS signal in space in order to compute and output a position solution, deviations relative to a desired reference path and appropriate annunciation.

First, the GPS satellites provide both the airborne subsystem and a ground-based subsystem with ranging signals. Second, the ground subsystem produces ground-monitored differential corrections and integrity-related information as well as data including the definition of the final approach path, a geometric path in space to which the aircraft on approach will navigate. These data are transmitted on a VHF data broadcast (VDB) to the airborne subsystem. The content and format of the data provided via the VDB are defined in RTCA, GNSS-Based Precision Approach Local Area Augmentation System (LAAS) Signal-in-Space Interface Control Document (ICD). Third, ground based APL's may be used to provide additional ground-monitored ranging signals to the airborne system.

The airborne subsystem uses the GPS/LAAS SIS (signal in space) to calculate a differentially-corrected position estimate and generates deviation signals with respect to the final approach path. The airborne subsystem also provides appropriate annunciations of system performance (e.g alerts). A position-velocity-time (PVT) output with integrity is also provided and may support other applications.

The airborne subsystem outputs are formatted as appropriate to interface with other aircraft equipment used to support the particular operation. For example, "ILS lookalike" deviation outputs are provided to aircraft displays and/or navigation systems. The airborne subsystem also provides appropriate annunciations of system performance (e.g alerts).

A plurality of IMLA's (FIG. 1) described herein, significantly reduce the inherent multipath corruption in ground based GPS reference stations. This multipath reduction ability allows the LAAS to support CAT I/II/III type approach and landings with the accuracy and integrity required while only depending on the GPS L1 C/A carrier smoothed code signal.

Published research on methods to reduce the amount of ground multipath by Ohio University have helped optimize the method used to attenuate the LAAS GPS multipath to a minimum. As shown in FIG. 18, Ohio University's idea of dividing the hemispherical coverage into 2 separate antenna beams has allowed an antenna design which can provide significantly better multipath performance than a single beam approach. This concept was originally published in 1994 by Ohio University.

This type of dual beam antenna system divides the required hemispherical coverage volume into two or more pieces in order to optimize the antenna's performance. The main discovery that Ohio University made when proposing this dual beam antenna approach was that the High Zenith Antenna could be made to fill in the natural "Null" that occurs directly above a collinear array of vertically polarized radiating elements.

The dominant error source in differential global positioning systems (DGPS) applications is multipath. Multipath occurs when a signal arrives at its destination via multiple paths resulting from reflections and/or diffractions. Multipath is troublesome to navigation ranging systems when the signal amplitude of the multipath is strong relative to the direct signal. In addition, since reflections and diffractions involve larger path lengths than the direct signal, they incur a time delay, which can affect GPS code or carrier measurements. This time delay is a significant problem for GPS since it performs time-based ranging measurements.

Ground multipath from satellite transmissions is the largest error source for the LAAS because of its close proximity to the ground and its nearly static geometry.

The invention described herein deals mainly with antenna techniques to reduce ground multipath. By shaping the antenna gain, phase and group delay patterns appropriately, the amount of multipath, phase and group delay errors that enter the receiver front end can be significantly reduced. A common way to characterize an antenna's multipath rejection capability is in terms of a power ratio referred to as the desired-to-undesired (D/U) ratio. The D/U ratio is also known as direct-to-indirect ratio, down-to-up ratio and a variety of other names. The D/U ratio is calculated for a given elevation angle in order to assess the ground multipath rejection capability of an antenna and thus tells how many dB of multipath can be rejected after the radio frequency (RF) stages of a transmitter and before the RF stages of a receiver. D/U is shown graphically in FIG. 19.

SUMMARY OF THE INVENTION

The above stated system requirements led to the development of a dual beam antenna system which significantly reduces multipath errors before they enter the receiver front end.

Another objective of the invention was to create an antenna which provides full hemispherical coverage while maintaining excellent multipath performance as well as excellent gain and phase stability with minimal group delay over the operational frequency band. The invention consists of the integration of a High Zenith Antenna (HZA) and a Multipath Limiting Antenna (MLA) which together form the Integrated Multipath Limiting Antenna (IMLA). The HZA receives GPS information from high elevation satellites (30 degrees through 90 degrees) at all azimuths and the MLA receives GPS information from low elevation satellites (2 degrees through 35 degrees) at all azimuths.

The invention also provides complete environmental protection for stable operation in an airport environment for extended periods of operation.

BRIEF DESCRIPTION OF THE DRAWINGS

In the drawings.

Item 17—outer radome fiberglass
Item 18—spacer, sponge rubber
Item 19—inner radome fiberglass
Item 20—array multi element (14 or 16 element typical)
Item 21—high zenith antenna (HZA)
Item 22—pipe adapter for antenna mounting
Item 25—RF power distribution assembly (PDA) microstrip
Item 44—low noise amplifier and filter

Item 17—outer radome fiberglass
Item 18—spacer, sponge rubber
Item 19—inner radome fiberglass
Item 22—pipe adapter for antenna mounting
Item 23—array pseudolite multi element (20 element typical)
Item 24—obstruction light/air terminal adapter
Item 25—RF power distribution assembly (PDA) microstrip

Item 25—RF power distribution assembly (PDA) microstrip
Item 26—RF power/phase coax transmission line system (14 to 20 element typical)

Figure 4:
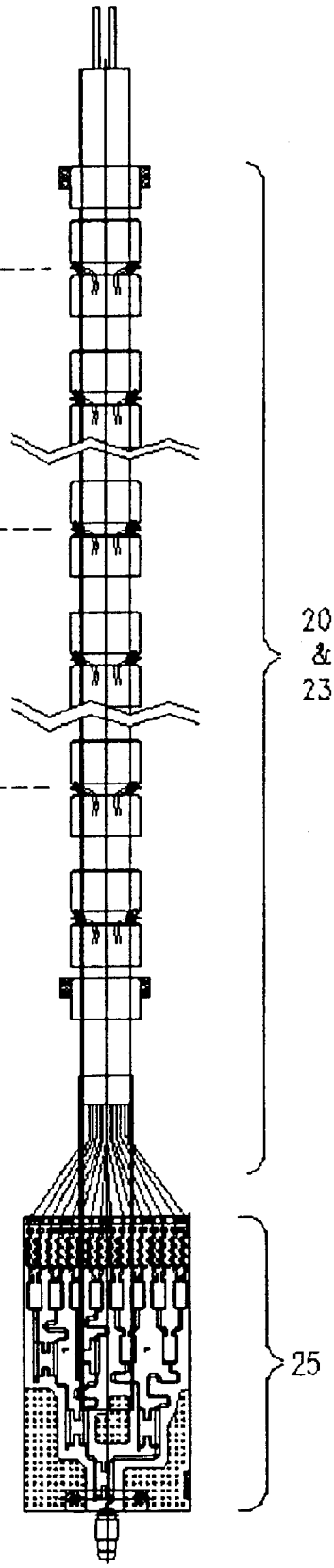
Figure 5:
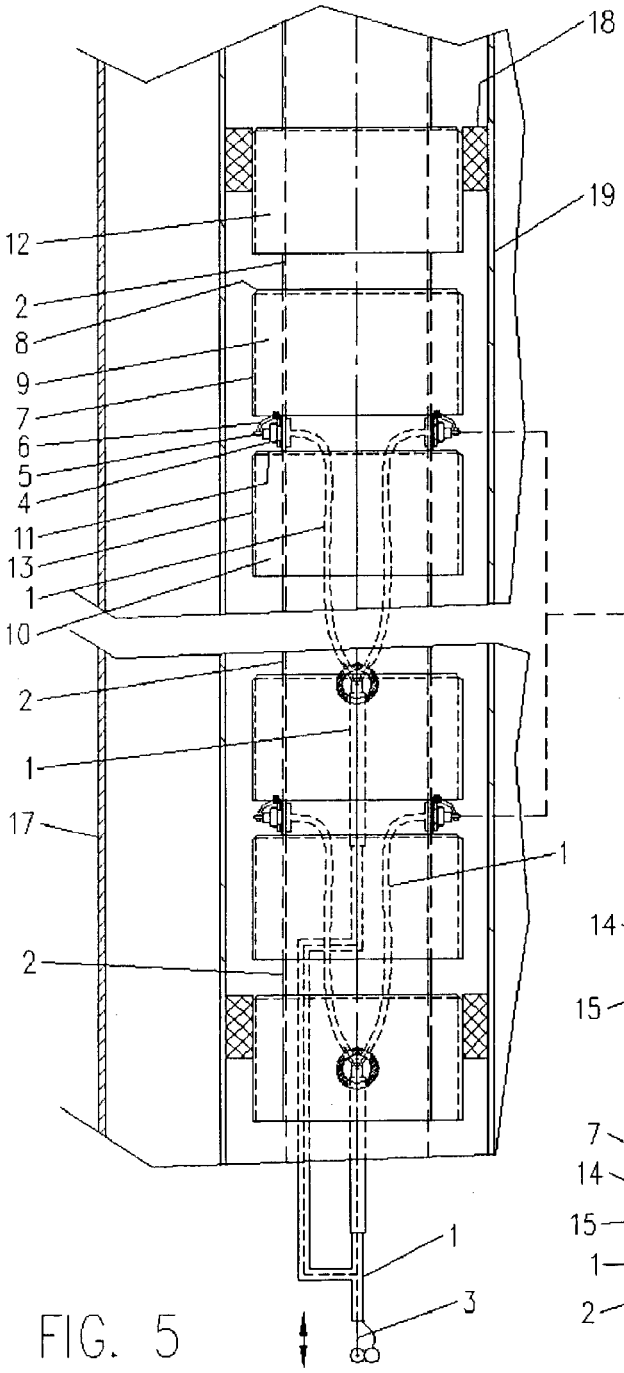
Figure 5B:
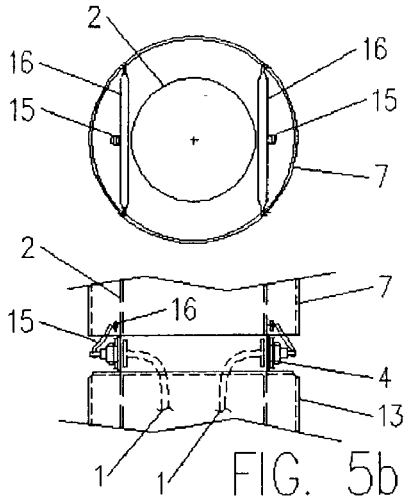
Figure 5A:
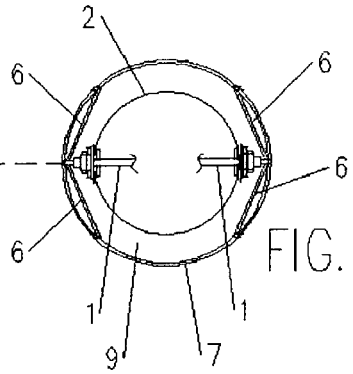
Figure 5C:
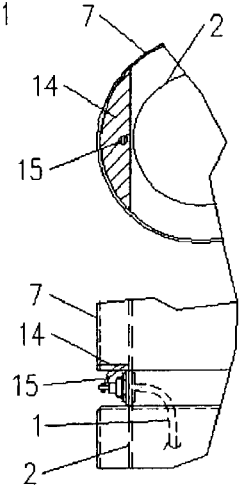
Figure 5D:
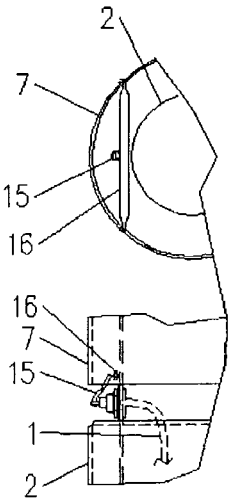
Figure 6:
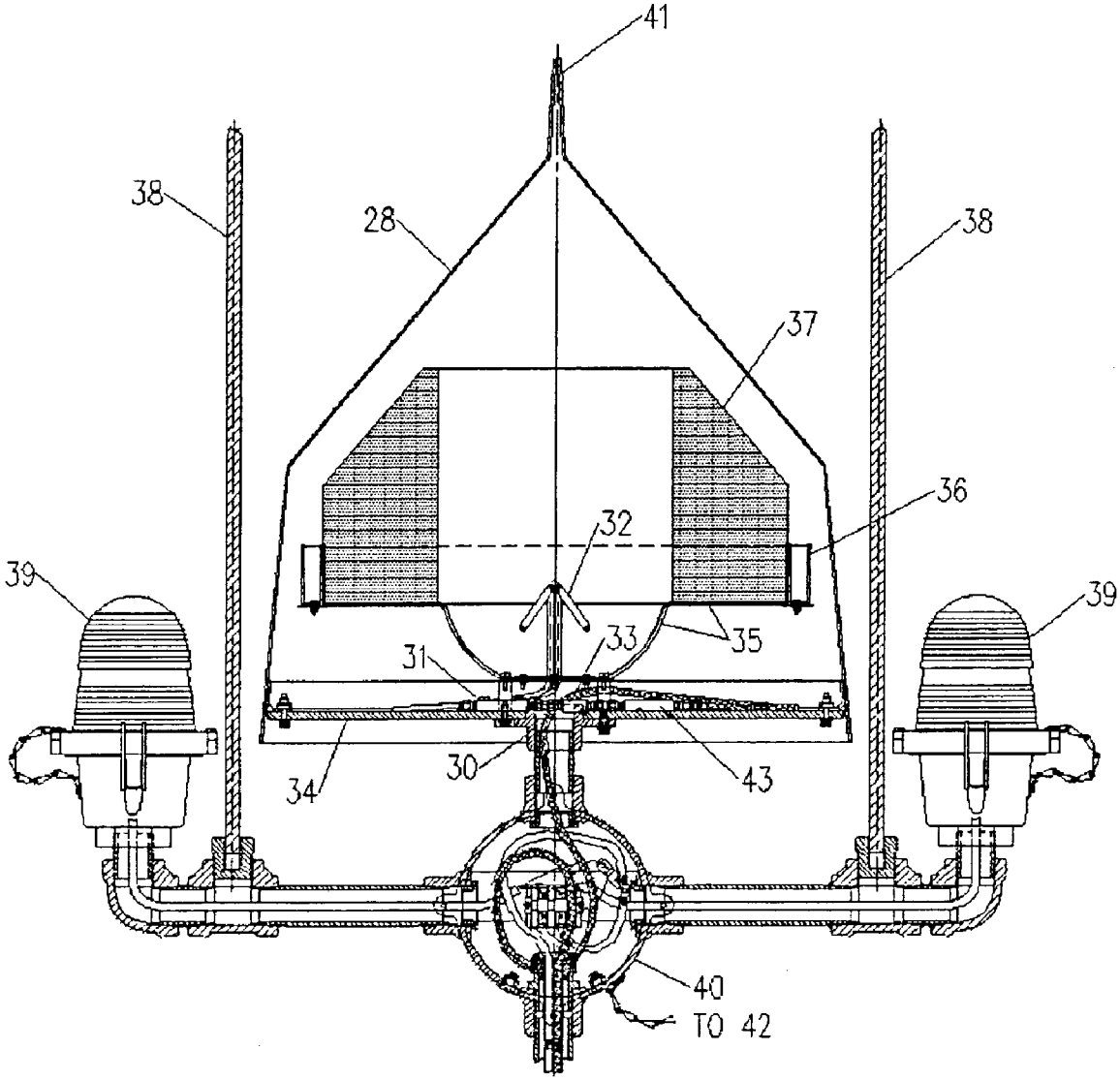
Figure 17:
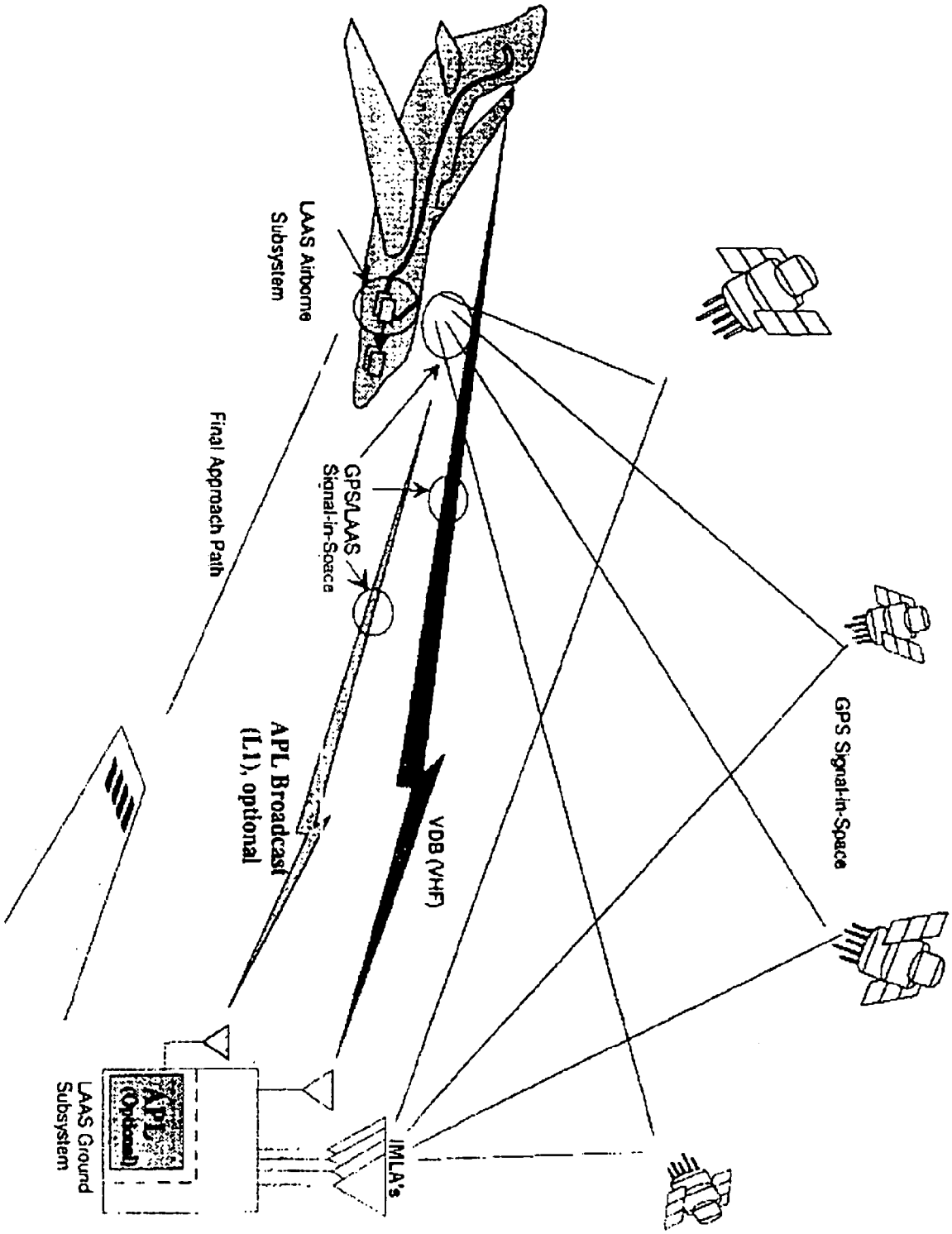
Prior Art Figure 17

FIG. 4 is a fragmentary diagrammatic side elevational view of the radiating elements (cylindrical dipoles and upper/lower RF chokes) and RF feed distribution network for both the MLA & WBAPL. The Figure includes:

Item 20—array multi element (14 or 16 element typical)
Item 23—array pseudolite multi element (20 element typical)
Item 25—RF power distribution assembly (PDA) microstrip FIG. 5 is an enlarged fragmentary sectional view of symmetrically fed metallic radiating cylindrical dipoles and a RF decoupling upper cylindrical choke, all positioned around the metallic center support tube. The Figure includes:

Item 1—RF power/phase coax transmission line system
Item 2—central metal support tube
Item 3—signal source
Item 4—coax feed thru
Item 5—feed thru outer end
Item 6—RF feed wire
Item 7—upper dipole half
Item 8—conductive bulkhead
Item 9—upper dipole half cavity
Item 10—lower dipole half cavity
Item 11—lower dipole bulkhead
Item 12—array end RF choke cavity
Item 13—lower dipole half
Item 17—outer radome fiberglass
Item 18—spacer, sponge rubber
Item 19—inner radome fiberglass FIG. 5*a* is an enlarged fragmentary sectional view of a cylindrical dipole symmetric feed using wires and coax feed thru center tube wall. The Figure includes:

Item 1—RF power/phase coax transmission line system
Item 2—central metal support tube
Item 6—RF feed wire
Item 7—upper dipole half
Item 9—upper dipole half cavity FIG. 5*b* is an enlarged fragmentary sectional view of a cylindrical dipole symmetric feed using conductive cross-bars and couplers (in lieu of wires) and coax feeds thru center tube wall. The Figure includes:

Item 1—RF power/phase coax transmission line system
Item 2—central metal support tube
Item 4—coax feed thru
Item 7—upper dipole half
Item 13—lower dipole half
Item 15—feed coupler
Item 16—symmetric feed cross-bar FIG. 5*c* is an enlarged fragmentary sectional view of non-symmetric feed using inductance reducer and coax feeds thru center tube wall. The Figure includes:

Item 1—RF power/phase coax transmission line system
Item 2—central metal support tube
Item 7—upper dipole half
Item 14—non-symmetric feed inductance reducer
Item 15—feed coupler FIG. 5*d* is an enlarged fragmentary sectional view of non-symmetric feed using single cross-bar and coupler, and coax feed thru center tube wall. The Figure includes:

Item 1—RF power/phase coax transmission line system
Item 2—central metal support tube
Item 7—upper dipole half
Item 15—feed coupler
Item 16—symmetric feed cross-bar FIG. 6 is a schematic view of the High Zenith Antenna (HZA) forming part of the IMLA antenna system showing the obstruction lights, air terminals and junction box. The Figure includes:

Item 28—radome HZA fiberglass
Item 30—hub center support
Item 31—90 degree power hybrid combiner
Item 32—cross-V-dipole
Item 33—ferrite isolator
Item 34—lower counterpoise (beam forming) and aluminum mounting plate
Item 35—concave reflector and upper counterpoise (beam forming)
Item 36—RF choke HZA large diameter 360 degrees
Item 37—microwave absorbing material (beam forming)
Item 38—air terminal 2 places
Item 39—obstruction light 2 places
Item 40—junction box with cover
Item 41—anti-bird spike
Item 42—cover junction box, not shown, part of lanyard
Item 43—low noise amplifier FIG. 7 shows measured elevation radiation gain patterns in dBi for: 14 element, 16 element and 20 element multipath limiting antennas (MLA's) where 0 degrees is the horizon, +90 degrees is straight up and −90 degrees is straight down into the ground;

FIG. 8 shows measured elevation radiation patterns for desired to undesired (direct to indirect) ratios in dB from 0 to 90 degrees for: 14 element, 16 element and 20 element MLA's where 0 degrees is the horizon and +90 degrees is straight up away from the ground;

FIG. 9 is same as FIG. 7 zoomed to an elevation angle span from −35 to 35 degrees;

FIG. 10 is the same as FIG. 8 zoomed to an elevation angle span from −35 to 35 degrees;

FIG. 11 is the same as FIG. 7 zoomed to an elevation angle span from −15 to 15 degrees;

FIG. 12 is the same as FIG. 8 zoomed to an elevation angle span from 0 to 15 degrees;

FIG. 13 shows measured MLA azimuth radiation patterns in dBi from 0 to 360 degrees at four different elevation angles;

FIG. 14 shows measured HZA right hand circular polarized (RHCP) vertical radiation pattern in dbic from 0 to 360 degrees; wherein 0 and 360 degrees are straight down, 90 and 270 degrees are on the horizon and 180 degrees is straight up;

FIG. 15 shows measured HZA RHCP azimuth radiation patterns in dBic from 0 to 360 degrees at 4 different elevation angles; and FIG. 16 shows how the HZA and MLA antenna radiation patterns superimpose to FIG. 17 "Prior Art" Typical LAAS System.

Figure 18:
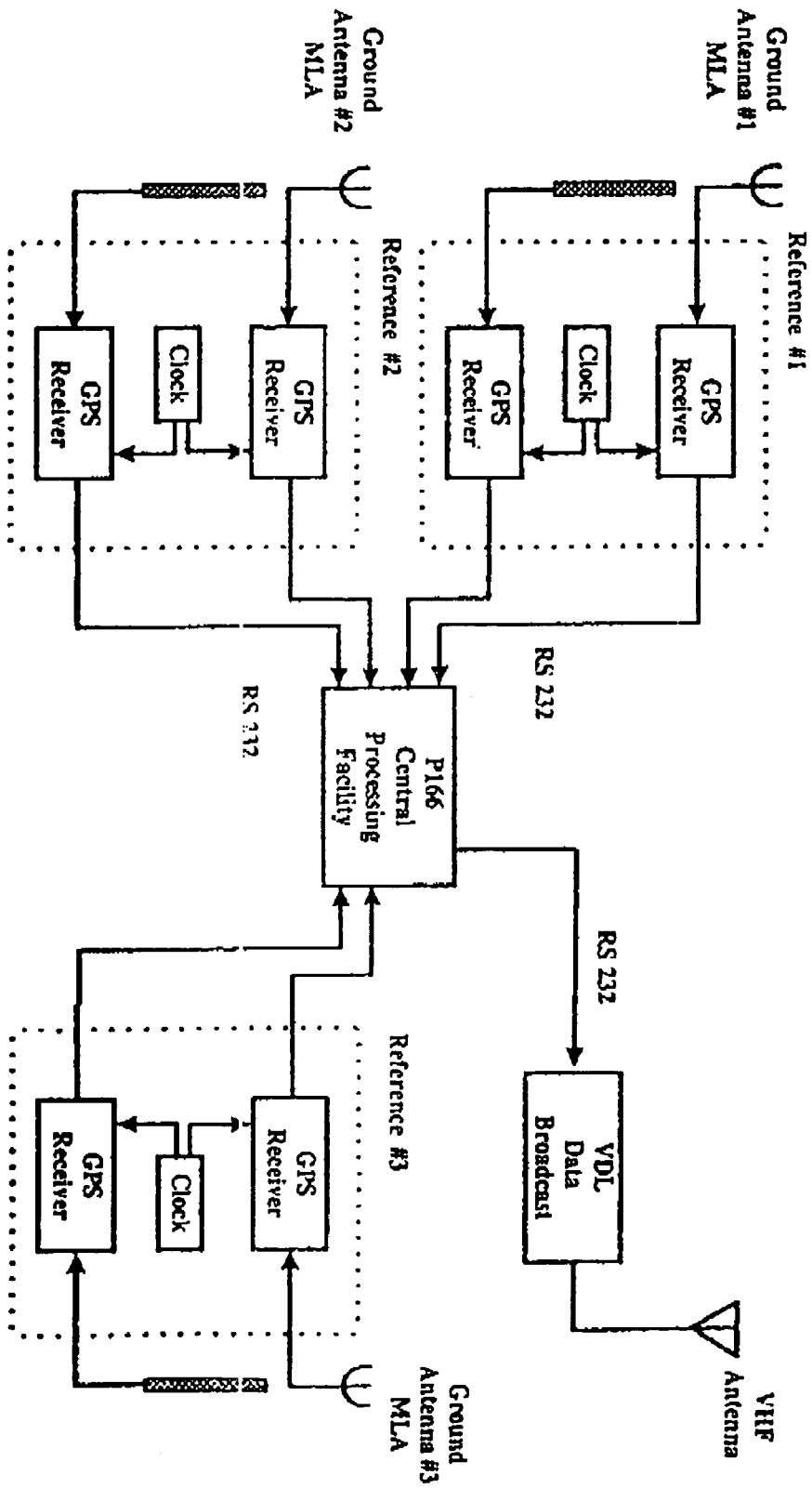
Prior Art Figure 18

FIG. 18 "Prior Art" LAAS Ground Sub-System Schematic Layout.

Figure 19:
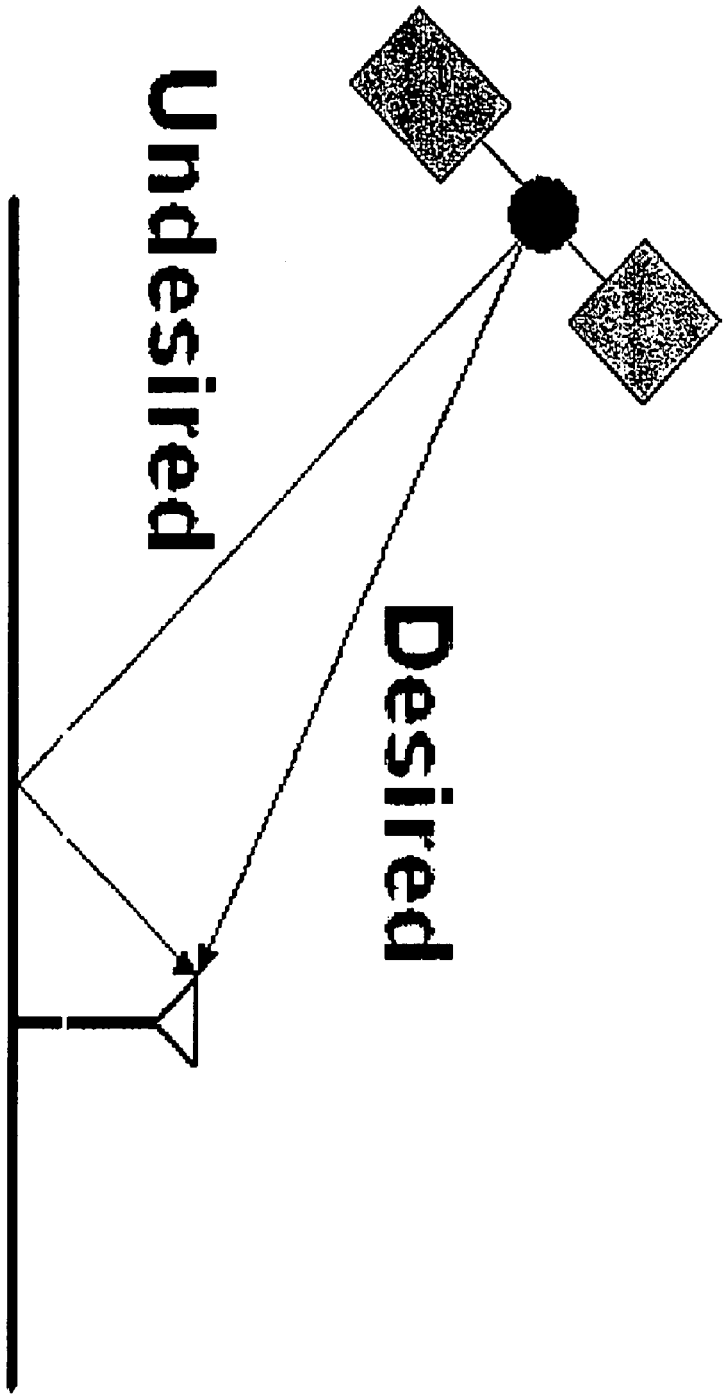
Prior Art Figure 19

FIG. 19 "Prior Art" Graphical illustration of the D/U ratio. provide complete above the horizon coverage.

DETAILED DESCRIPTION OF THE PREFERRED EMBODIMENTS

I. Multipath Limiting Antenna (MLA)

Figure 1:
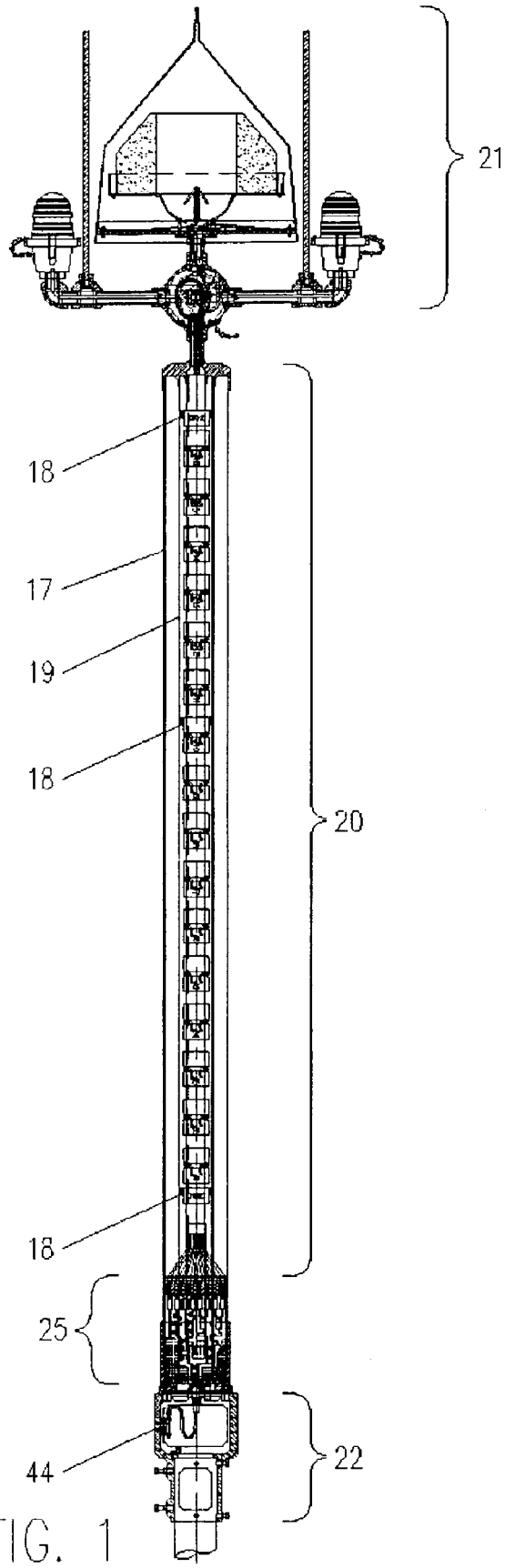
FIG. 1 is a diagrammatic side elevational view of a 16 element MLA configured into a Integrated Multipath Limiting Antenna (IMLA). This drawing includes the High Zenith Antenna (HZA), junction box, dual obstruction lights, dual lighting protectors and pipe mounting adaptor. The Figure includes.

FIG. 1 illustrates an integrated multipath-limiting antenna (IMLA) which includes: MLA array multi element 20, high zenith antenna (HZA) 21 and a pipe adaptor for antenna mounting 22. The MLA has a coaxially configured outer radome fiberglass 17 and inner radome fiberglass 19 for greater strength, durability, longitudinal stiffness and a means to heat (de-ice) the antenna when required. The High Zenith Antenna (HZA) includes air terminals, dual obstruction lights and a junction box.

For detailed theory of operation of the MLA refer to FIG. 5, where central metal support tube 2 contains a RF power/phase coax transmission line system 1 which comes from a signal source (receiver or transmitter or both). The RF power/phase coax transmission line system 1 goes thru the wall of the central metal support tube 2, via coax feed thru 4, 1 & 2 are fastened together securely locked and soldered so that no RF energy is fed into the inside of central metal support tube 2. The connection at feed thru outer end 5 thru RF feed wire 6 is to a metallic cylindrical dipole approximately ¼ wavelength long. Cylindrical upper dipole half 7 is conductively coupled (soldered) to central metal support tube 2 by a conductive bulkhead 8. The current on the outside of upper dipole half 7 can flow without interruption until it gets to the central metal support tube 2. The current flow along upper dipole half 7 is then radiated omnidirectionally in azimuth since no metallic items are present to alter the non-directional radiation.

The other region experiencing the voltage existent between the center conductor of RF power/phase coax transmission line system 1 and the shield of RF power/phase coax transmission line system 1 is the lower dipole half cavity 10 closed and electrically connected to central metal support tube 2 at the upper end by the lower dipole bulkhead 11.

It is well known from transmission line theory that the input impedance of a shorted quarter wave line is $Z=+j\beta_0 \tan\theta$. In this case θ is essentially 90 degrees. Therefore, the input impedance to lower dipole half cavity 10 is either very high or infinite. The lower dipole half cavity 10 has little effect on the impedance presented to RF power/phase coax transmission line system 1. However, the current flowing along the outside of upper dipole half 7 is experiencing radiation resistance.

Mounted on central metal support tube 2 above upper dipole half 7 is a array end RF choke cavity 12 with the same dimensions as upper dipole half 7 and upper dipole half cavity 9. When the current flowing along upper dipole half 7 gets to the conductive bulkhead 8, it tries to flow into array end RF choke cavity 12 which also has high input impedance. Since this impedance is very high, it essentially acts as an open circuit or end of line. The MLA linear (collinear) array includes a single or multiplicity of RF chokes at each end of central metal support tube 2 which effectively eliminates unwanted RF current flow along central metal support tube 2.

Some of the voltage on the center conductor of RF power/phase coax transmission line system 1 is impressed on the lower dipole bulkhead 11. The current produced by this voltage runs along lower dipole half 13 experiencing radiation resistance for essentially a quarter wavelength. The input impedance to lower dipole half cavity 10 is very high so very little energy continues down central metal support tube 2. The lower dipole half 13 acts like a quarter wave radiator. The current flowing along lower dipole half 13 is of opposite phase to that flowing along upper dipole half 7. Since it is flowing in the opposite direction, its radiation is in phase with the radiation from upper dipole half 7. These two excited quarter wavelength radiators, FIG. 5 items upper dipole half 7 and lower dipole half 13, then form something equivalent to a half wavelength cylindrical dipole. The diameter of this cylindrical dipole is made electrically large to allow for significant operating bandwidth. This provides excellent group delay response from the array multi element 20.

The number of half wavelength dipoles used in one MLA array can be from 2 to n depending on the desired gain and pattern slope requirements. The current MLA arrays contain: fourteen, sixteen and twenty half wavelength dipoles.

FIGS. 5, 5*a* and 5*b* describe symmetrical feeds where the driven element (cylindrical dipole half/cavity) of each half wavelength dipole is fed at four equally spaced points around its open end circumference. Symmetrical feeds improve the radiated azimuth pattern circularity over the non-symmetric feed methods (see FIG. 13). Symmetric feeds shown in FIGS. 5 and 5*a* are referred to as RF feed wires 6. Those shown in FIG. 5*b* are referred to as symmetric feed cross-bar 16 & feed coupler 15 symmetric feeds.

Non-symmetric feeds shown in FIGS. 5*c* and 5*d* are used in arrays having lesser circularity requirements and are less costly to build, 5*c* is referred to as non-symmetric feed inductance reducer 14 and feed coupler 15, 5*d* is referred to as symmetric feed cross-bar 16 and feed coupler 15.

Inductance reducer FIG. 5*c* is used for a low cost non-symmetrical feed. The circumference of the open end of upper dipole half 7 is an appreciable portion of a wavelength. In the case of upper dipole half 7, in order to reduce this inductance, a non-symmetric feed inductance reducer 14 of metallic plate is connected to a short feed coupler 15 shown in FIG. 5*c*. The non-symmetric feed inductance reducer 14 allows for a some what shortened length of feed coupler 15 in feeding the circumference at the bottom of upper dipole half 7.

Spiral feed (not shown in the figures) for non-symmetrical feeds are also used to improve azimuth pattern circularity. In some cases where non-symmetrical feeds are used, each feed is rotated a number of degrees, in azimuth, from the one below it. This results in a total radiation pattern that is more circular than from a non-spiraled feed system, however, symmetrical feeds provide the best circularity.

In FIG. 5 outer radome fiberglass 17, spacer, sponge rubber 18 and inner radome fiberglass 19 make up the multi-purpose antenna support structure and provide environmental protection.

MLA vertical radiation pattern. See FIG. 1 (array multi element 20 and RF power distribution assembly (PDA) microstrip 25), FIG. 3 (RF power distribution assembly (PDA) microstrip 25 and RF power/phase coax transmission line system 26) and FIG. 4 (RF power distribution assembly (PDA) microstrip 25, array multi element 20 and array pseudolite multi element 23). Vertical pattern shaping is critically important in achieving satisfactory performance for LAAS, especially in the vicinity of the horizon. To achieve the required multipath rejection each half wave dipole (driven element) in the array FIG. 1 (array multi element 20) must receive RF at the exact magnitude (amplitude) and at the exact time (phase) relative to all the other active elements in the array. The phase fed to each element must also be very constant as a function of the antenna bandwidth to minimize group delay variation which causes errors in GPS ranging.

Figure 3:
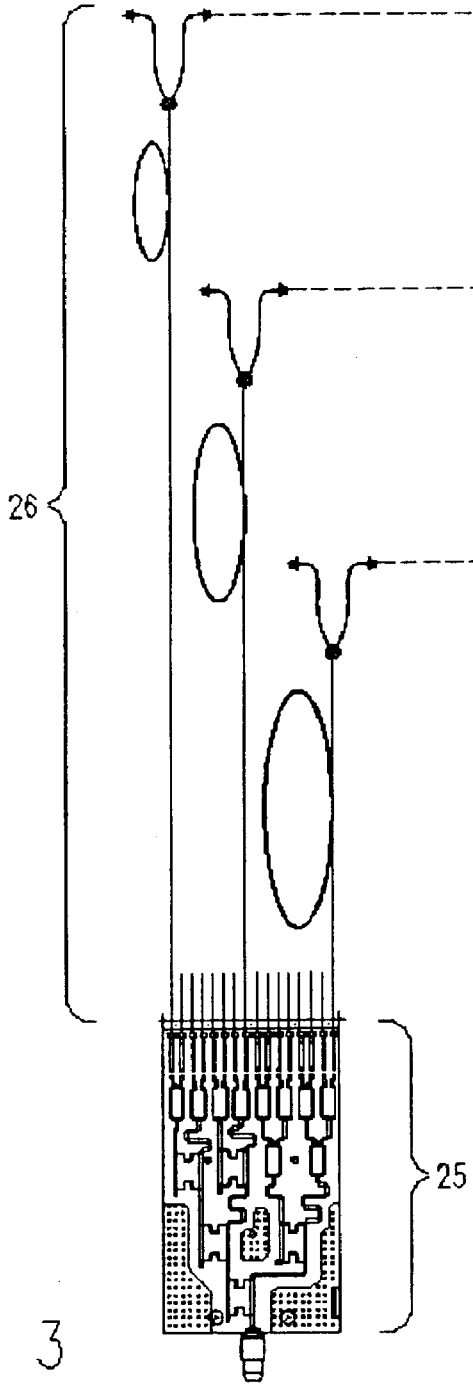
FIG. 3 is a fragmentary internal schematic side elevational view of the amplitude and phase RF feed distribution network for both MLA and WBAPL. The Figure includes.

To determine these critical RF amplitudes and phases a highly sophisticated/customized pattern synthesis computer program was developed which provides independent control of each lobe and null depth in the vertical radiation pattern. FIG. 1 (RF power distribution assembly (PDA) microstrip 25) is a printed wiring board which divides/sums the RF energy in the synthesized, correct manner to/from each driven element. FIG. 3 (RF power/phase coax transmission line system 26) is the coaxial feed harness which aids in the formation of the correct amplitude/phase distribution across the array aperture. To the maximum extent possible these coax lengths, FIG. 3 (RF power/phase coax transmission line system 26), provide the same electrical delay which is fed to each dipole which helps provide larger bandwidth, less temperature susceptibility and more constant group delay as a function of frequency.

As the number of active elements in the array is increased, greater vertical pattern beam control is obtained. Spacing between active elements (see FIG. 4 array multi element 20 and array pseudolite multi element 23) is also an important factor which can be varied to obtain optimum pattern beam shape. Measured antenna patterns (detailing actual MLA array performance) are shown in FIGS. 7, 8, 9, 10, 11 and 12.

II. Wideband Airport Pseudolite Multipath Limiting Antenna (WBAPL)

Figure 2:
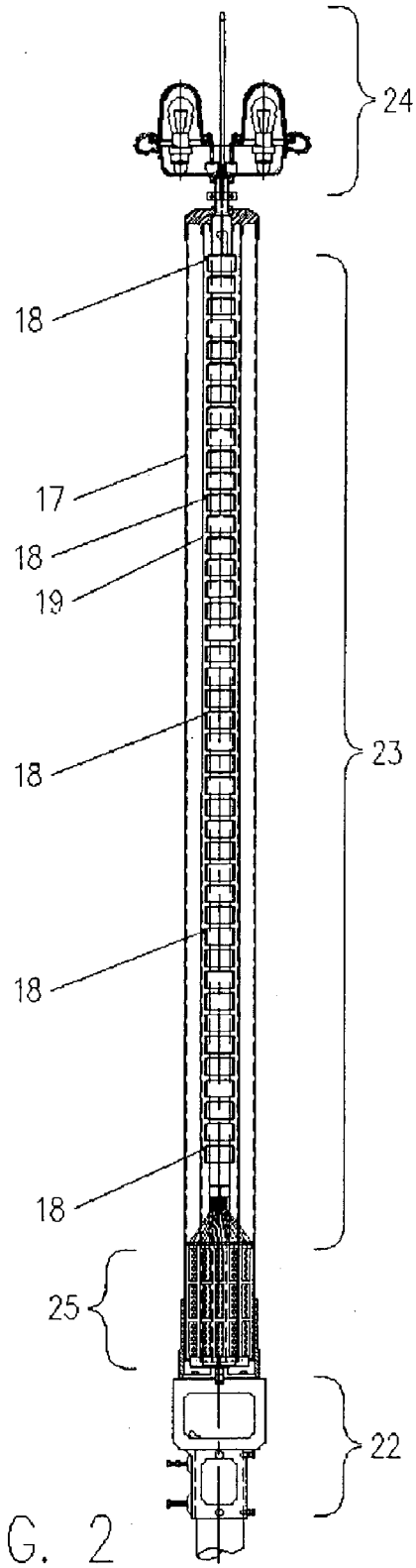
FIG. 2 is a diagrammatic side elevational view of a 20 element MLA configured for Wideband Airport Pseudolite (WBAPL) transmissions with dual obstruction lights, air terminal and pipe mounting adaptor. The WBAPL may be deployed with or without an HZA. The Figure includes.

See FIG. 2 WBAPL vertical pattern, FIG. 2 (array pseudolite multi element 23 and RF power distribution assembly (PDA) microstrip 25), FIG. 3 (RF power distribution assembly (PDA) microstrip 25 and RF power/phase coax transmission line system 26) and FIG. 4 (array multi element 20, array pseudolite multi element 23 and RF power distribution assembly (PDA) microstrip 25). The theory and techniques used and described in the MLA description are the same for that of WBAPL. The WBAPL, however, has equal to or greater multipath rejection capabilities, greater gain vs. angle control and greater vertical angle coverage than the MLA. The MLA WBAPL is a 20 active element array FIG. 2 (array pseudolite multi element 23); it may be deployed with or without the high zenith antenna 21. It may be deployed with only obstruction light/air terminal adapter 24 if desired. Measured antenna patterns (detailing actual WBAPL array performance) are shown in FIGS. 7, 8, 9, 10, 11 and 12.

III. High Zenith Antenna (HZA)

See FIG. 6. The HZA is designed to receive satellite signals from +30 degrees to +90 degrees in elevation angle above the horizon. Thus when integrated with the MLA, complete hemispherical coverage is obtained. The greater the number of satellites received, the greater the system accuracy, availability and integrity. The HZA radiation pattern must be commensurate with the performance of the MLA, see FIG. 16.

The HZA is preferably enclosed in a radome HZA fiberglass 28 with associated hub center support 30 and lower counterpoise (beam forming) and aluminum mounting plate 34 for mounting and environmental protection. The HZA has an integral low noise amplifier 43 used to amplify low-level GPS signals and a 90 degree power hybrid combiner 31 for proper connection to the cross-V-dipole 32 which functions to combine the cross-V-dipole 32 in the RHCP sense. The symmetrical cross-V-dipole radiating element helps maintain close to equal vertically and horizontally polarized RHCP orthogonal components. The cross-V-dipole exhibits a very stable and accurate phase center as well as a minimal group delay due to its electrical symmetry and large operational bandwidth. This results in a significant improvement of the antenna's ellipticity ratio over the usable service volume.

A ferrite isolator 33 is also utilized at the antenna output which absorbs any possible reflections which may occur in the RF interconnection between the antenna and the GPS receiver. Impedance mismatches and/or cable reflections may result in standing waves in the interconnecting cables which can look like multipath to the GPS receiver.

An L1 band pass filter (not shown) can be installed before the LNA to reduce out of band signals which may cause interference to the GPS receiver. The MLA is also equipped with a low noise amplifier and filter, FIG. 1 item 44 which are located below the MLA in the pipe adapter for antenna mounting 22 which is used to adapt the IMLA to a 4" O.D. pipe for mounting purposes.

The HZA implements a combination of antenna technologies including:

A) A flat, conductive, reflecting lower counterpoise (beam forming) and aluminum mounting plate 34 oriented orthogonal to the vertical axis of the antenna.

B) A shaped concave reflector and upper counterpoise 35 electrically connected to the lower counterpoise 34 which electrically and mechanically connects to the cross-V-dipole 32.

C) A 360 degree oriented, quarter wave, RF choke 36 which aids in the suppression of the surface wave which exists on the surface of the microwave absorbing material 37.

D) A beam forming shaped piece of RF absorbing material 37 with a precisely known and controlled carbon fill factor. This "Shaped Absorber" provides controlled positive angle radiation through use of its shaped inside contour as well as a shaped outside contour to control the broadside and negative angle portions of the radiation pattern.

See FIGS. 14 and 16. The pattern above the horizon is shaped to yield a maximum pattern variation of approximately 5 dB between the vertical angles of +30 degrees and +90 degrees. The main beam peak gain is approximately 2 dBic.

The vertical phase pattern of the HZA is nearly constant and does not change more than 2 cm over the HZA coverage volume.

The horizontal azimuth patterns of the HZA are shown in FIG. 15. The phase variation in the horizontal plane is circular and exhibits the expected 360 degree linearly progressing phase shift for a RHCP antenna.

See FIG. 6 items 38 are air terminals 2 places, 39 are obstruction lights 2 places, 40 is a junction box with cover for cable connections. (Cover junction box 42 and lanyards not shown.)

The above descriptions are those of preferred embodiments of the invention. Various alterations and changes can be made without departing from the spirit and broader aspects of the invention as defined in the appended claims.

What is claimed:

1. An integrated dual antenna system having broadband elements and nearly constant group delay that provides complete upper hemispherical coverage, comprising (a) an MLA antenna having both active and RE choke large diameter cylindrical dipole elements and coaxial feed lines each of which is connected to an active cylindrical dipole element, each of said feed lines having line lengths which vary in length plus or minus only the length required to achieve a desired phase variation across the antenna aperture; and (b) an HZA antenna having a broad-band cross-V-dipole, so that together the HZA and MLA antennas provide a large bandwidth with radiation characteristics that are not sensitive as a function of relative element geometries between the HZA and MLA antennas, and wherein said system implemer is a multiplicity of techniques to achieve high D/U ratio, S/N ratio, low sidelob: levels and gain flatness, minimum phase and group delay in its coverage area which has in combination:

a) a flat, conductive, counterpoise oriented orthogonal to the vertical axis of the antenna system;

b) a shaped concave reflector and associated counterpoise electrically connected to a second conductive counterpoise which electrically and mechanically connects the cross-V-dipole to a beam forming network;

c) a vertically oriented, quarter wave, RF choke which suppresses the surface wave traveling along the surface of a microwave absorbing material;

d) a precisely shaped piece of RF absorbing material with specific carbon fill factor having a shaped inside surface to control a positive angle radiation pattern and whose shaped outside surface helps control the broadside and negative angle portions of the radiation pattern;

e) a highly symmetric cross-V-dipole having RHCP output polarization which produces a symmetry and ellipticity ratio over the service volume; and f) a specifically defined geometry between each mutually interactive element of the HZA antenna.

2. An antenna system as set forth in claim 1, wherein the precise longitude, latitude and height location of the MLA antenna with respect to the HZA antenna is determined by establishing a precise survey of the HZA antenna phase center location in terms of longitude, latitude and height such that only a height offset between the HZA antenna phase center and the antenna range measured MLA antenna phase center need be used to determine the longitude, latitude and height phase center of the MLA antenna; making possible the precise phase corrected three-dimensional determinations of both the HZA and MLA antenna locations.

3. An antenna system as set forth in claim 1, which utilizes broadband radiating elements to minimize antenna group delay variation of the antennas as a function of vertical angle, incorporating broadband elements/components with IMLA techniques and components having demonstrated bandwidths great enough to cover GPS frequencies L5 1176.45 MHz, L2 1227.60 MHz and L1 1575.42 MHz without tuning or adjustment.

4. An antenna system as set forth in claim 1 in which the MLA antenna provides a very high rate of signal roll-off in the vicinity of the horizon in order to suppress potential jamming signals which are located on the horizon, said system having a tall, multi-wave length, vertically stacked, dipole array and precise control of the phase/amplitude distribution along the dipole array.

5. An integrated antenna system as set forth in claim 1, providing comparable jamming resistance against terrestrially located jamming transmitters for both the MLA and HZA antennas having jamming resistance being optimized by signal level drop-off between +5 degrees and 0 degrees for said MLA antenna being approximately 23 dB, whereas the signal level drop-off between +35 degrees and 0 degrees for the HZA antenna is 22 dB, so that when combined the resulting Integrated Multipath Limiting Antenna (IMLA) provides approximately 22–23 dB of jamming resistance against terrestrially located transmitters.

6. An integrated dual antenna system having broadband elements and nearly constant group delay that provides complete upper hemispherical coverage, comprising (a) an MLA antenna having both active and RF choke large diameter cylindrical dipole elements and coaxial feed lines each of which is connected to an active cylindrical dipole element, each of said feed lines having line lengths which vary in length plus or minus only the length required to achieve a desired phase variation across the antenna aperture; and (b) an HZA antenna having a broad-band cross-V-dipole, so that together the HZA and MLA antennas provide a large bandwidth with radiation characteristics that are not sensitive as a function of relative element geometries between the HZA and MLA antennas; such that a large, hollow, thick wall, multi-purpose, metal, center support tube in conjunction with said MLA cylindrical dipole elements such that the ratio of the diameter of the central metal support tube (2) to the diameter of the upper dipole half (7) and lower dipole half (13) can be as large as to 0.9 and so that the radius of the upper dipole half (7) and lower dipole half (13) is allowed to be smaller than one quarter wavelength and can be as small as 0.1 wavelengths as long as the central metal support tube (2) diameter is adjusted accordingly to allow for a gap between the central metal support tube (2) and the upper dipole half (7) and lower dipole half (13) so that said gap is at least 0.01 wavelengths and where said diameter ratio provides a maximization of the volume within the central metal support tube (2) for an RF power/phase coax transmission line system (1) along with other cables to be installed within the central metal support tube (2), where said transmission line system (1) and other cables are contained completely within the central metal support tube (2) and do not degrade or affect the radiation patterns of the MLA or other antennas or other antennas located above the MLA and where said diameter ratio provides a circumference of the upper dipole half (7) and lower dipole half (13) such that when fed with a multiplicity of feed wires consisting of at least one of an RF Feed wire (6) and symmetric feed crossbar (16) and feed coupler (15), the phase variation in the azimuth plane is reduced to less than 10 electrical degrees over the entire 360 physical degrees of azimuth angle.

* * * * *